US011696617B2

(12) United States Patent
Waugh

(10) Patent No.: US 11,696,617 B2
(45) Date of Patent: Jul. 11, 2023

(54) FOOTWEAR WITH TOE BAR

(71) Applicant: Critts, LLC, Magnolia, TX (US)

(72) Inventor: Carter R. Waugh, Magnolia, TX (US)

(73) Assignee: Critts, LLC, Magnolia, TX (US)

( * ) Notice: Subject to any disclaimer, the term of this patent is extended or adjusted under 35 U.S.C. 154(b) by 761 days.

(21) Appl. No.: 16/383,536

(22) Filed: Apr. 12, 2019

(65) Prior Publication Data

US 2020/0323305 A1 Oct. 15, 2020

(51) Int. Cl.
*A43B 7/26* (2006.01)
*A43B 3/10* (2006.01)

(52) U.S. Cl.
CPC ..... *A43B 7/26* (2013.01); *A43B 3/102* (2013.01)

(58) Field of Classification Search
CPC ..... A43B 7/26; A43B 3/102; A43B 3/12
See application file for complete search history.

(56) References Cited

U.S. PATENT DOCUMENTS 1,875,162 A * 8/1932 Sayers ..... A43B 7/26 36/11.5
2,506,308 A * 5/1950 Maynier ..... A43B 7/26 602/30
2,575,867 A * 11/1951 Ferri ..... A43B 7/26 602/30
2,575,868 A 11/1951 Ferri
2,928,191 A 3/1960 Meltzer
3,299,893 A * 1/1967 Collina ..... A43B 7/26 36/140
6,151,801 A * 11/2000 Frederiksen ..... A43B 3/105 36/11.5
7,134,225 B2 11/2006 Ashton
7,681,332 B2 * 3/2010 Allen ..... A43B 7/32 36/94
7,707,747 B2 5/2010 Nawachi et al.
8,117,768 B2 2/2012 Bobbett
8,739,434 B2 6/2014 Bishop
8,832,971 B2 9/2014 Heid
8,959,795 B2 2/2015 Cristea
(Continued)

OTHER PUBLICATIONS

Jennifer Kennedy, 12 Surprising Facts About Starfish, Aug. 4, 2017. https://web.archive.org/web/20171014023708/https:/www.thoughtco.com/facts-about-sea-stars-2291865 (Year: 2017).*

*Primary Examiner* — Bao-Thieu L Nguyen
(74) *Attorney, Agent, or Firm* — Santa Fe IP, LLC

(57) ABSTRACT

An article of footwear is configured to enclose and comfortably engage a forefoot of a user. The article includes a sole having a forefoot portion and a rearfoot portion, a closed-toe, open-heel upper configured to substantially prevent lateral and forward movement of the forefoot with respect to the forefoot portion, the upper with a lower perimeter attached to a forefoot perimeter of the forefoot portion and defining an interior configured to receive the forefoot of the user, and a stanchion extending upwardly through the interior, the stanchion with a bottom attached to the forefoot portion of the sole and a top attached to the upper, wherein the stanchion is configured to extend between and engage adjacent toes of the user to substantially prevent movement of the forefoot with respect to the forefoot portion of the sole. A method of using the footwear with toe bar is also disclosed.

20 Claims, 4 Drawing Sheets

(56) References Cited

U.S. PATENT DOCUMENTS

| | | | | |
|---|---|---|---|---|
| 9,072,338 | B1 | 7/2015 | Kostecky | |
| D771,360 | S | 11/2016 | De Brito | |
| 9,867,420 | B2 | 1/2018 | Steinberg | |
| 2002/0121030 | A1* | 9/2002 | Coleman | A43B 3/105 36/11.5 |
| 2002/0129517 | A1* | 9/2002 | Diaz | A43B 7/32 36/72 R |
| 2005/0229430 | A1 | 10/2005 | Takaba | |
| 2007/0011915 | A1* | 1/2007 | Allen | A43B 7/32 36/94 |
| 2011/0283563 | A1 | 11/2011 | Ferri | |
| 2013/0247419 | A1 | 9/2013 | Stewart | |
| 2013/0276331 | A1 | 10/2013 | Steel | |
| 2013/0333243 | A1 | 12/2013 | Dushey et al. | |
| 2014/0144046 | A1* | 5/2014 | Bhambhani | A43B 3/102 36/83 |
| 2015/0068059 | A1* | 3/2015 | Kinchington | A43B 7/26 36/11.5 |
| 2015/0374094 | A1* | 12/2015 | Gift | A45D 29/22 36/94 |
| 2016/0331063 | A1* | 11/2016 | Li | A43B 3/12 |
| 2017/0020232 | A1* | 1/2017 | Bello Decurnex | A43B 23/024 |
| 2017/0119085 | A1 | 5/2017 | Gerstenberger et al. | |
| 2019/0289957 | A1* | 9/2019 | Lee | A61F 5/019 |

* cited by examiner

FOOTWEAR WITH TOE BAR

BACKGROUND OF INVENTION

Field of Invention

This application relates, in general, to articles of footwear configured to enclose and comfortably engage a user's toes, and to methods for their use.

Description of Related Art

Flip-flops and other types of sandals have long been known for providing users with comfortable and casual footwear. Flip-flops are particularly well suited as children's footwear in that children can put on and take off flip-flops with great ease, merely slipping their feet into and out of the flip-flops. Such footwear advantageously allows children to avoid wasting time with tying laces, zipping zippers, and mating VELCRO strips. However, such footwear may not be sufficient for physical exertion, that it may not be adequate for running, jumping, climbing and other activities where it is highly desirable to keep one's footwear on one's feet.

On the other hand, conventional closed-toe footwear generally subjects users to the above-mentioned time sinks of tying laces, zipping zippers, mating VELCRO strips.

In light of the foregoing, it would be beneficial to provide footwear that is comfortable, secure, and easy to wear thus overcoming the above and other disadvantages of known footwear.

BRIEF SUMMARY

One aspect of the present invention is directed to an article of footwear configured to enclose and comfortably engage a forefoot of a user. The article includes: a sole having a forefoot portion and a rearfoot portion; a closed-toe, open-heel upper configured to substantially prevent lateral and forward movement of the forefoot with respect to the forefoot portion, the upper with a lower perimeter attached to a forefoot perimeter of the forefoot portion and defining an interior configured to receive the forefoot of the user; and an inter-toe stanchion extending upwardly through the interior, the stanchion with a bottom attached to the forefoot portion of the sole and a top attached to the upper, wherein the stanchion is configured to extend between and engage adjacent toes of the user to substantially prevent movement of the forefoot with respect to the forefoot portion of the sole.

The sole may include an insole, a midsole, and an outsole.

The insole may be cushioned.

The outsole may be a VIBRAM outsole.

The sole may include a midfoot portion, and the upper may include a topline partially defining an opening to the interior, wherein the lower perimeter of the upper may also be attached to a midfoot perimeter of the sole, and the opening may be located above the midfoot portion.

The upper may be leather.

The upper may include a plurality of animal-shaped openings.

The stanchion may be positioned medially of a longitudinal centerline of the sole.

The stanchion may be configured to extend between big and second toes of the user.

The stanchion may include a foam core.

The stanchion may include a stanchion lining encasing the foam core.

The stanchion may have a cylindrical shape.

The stanchion may have an elongated shape extending longitudinally along the sole.

The stanchion may have a form-fitting shape with concave recesses on medial and lateral sides of the stanchion.

The stanchion may be configured to extend between big and second toes of the user, and the medial-side and lateral-side recesses may be configured to abut against the big toe and the second toe, respectively.

The footwear may further include an upper lining along an interior surface of the upper, and the top of the stanchion may be attached to the upper lining and the upper.

Another aspect of the present invention is directed to an article of footwear including: a sole including a forefoot portion and a rearfoot portion; a closed-toe upper configured to substantially prevent lateral and forward movement of the forefoot with respect to the forefoot portion, with the upper attached to the forefoot portion and defining an interior configured to receive the forefoot of the user; an upper lining extending along an interior surface of the upper; and a toe bar extending upwardly through the interior. The toe bar includes a foam core and a toe-bar lining encasing the foam core, wherein a bottom of the lining is affixed to the forefoot portion of the sole and a top of the toe-bar lining is affixed to the upper lining, wherein the toe bar is configured to extend between and engage big and second toes of the user to substantially prevent movement of the forefoot with respect to the forefoot portion of the sole.

The outsole may be a VIBRAM outsole.

The upper may include a plurality of animal-shaped openings.

The toe bar may have a cylindrical shape.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Various embodiments of the present invention(s) will now be referenced in detail, examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In accordance with various aspects of the present invention, footwear having a closed-toe and open-heel configuration is provided with an upright support that extends internally between adjacent toes of a user in order to assist in keeping the footwear positioned on the user's feet. The footwear may also be provided with a generously cushioned insole to further assist keeping the footwear on the user's feet while providing, general comfort and support to the user, particularly while running, jumping and climbing.

Clogs, mules, and other conventional closed-toe/open-back footwear provide no such internal structure that assists in keeping footwear on. And such internal structure would be redundant and unnecessary for slip-ons and other conventional closed-toe/closed-back footwear.

Figure 1:
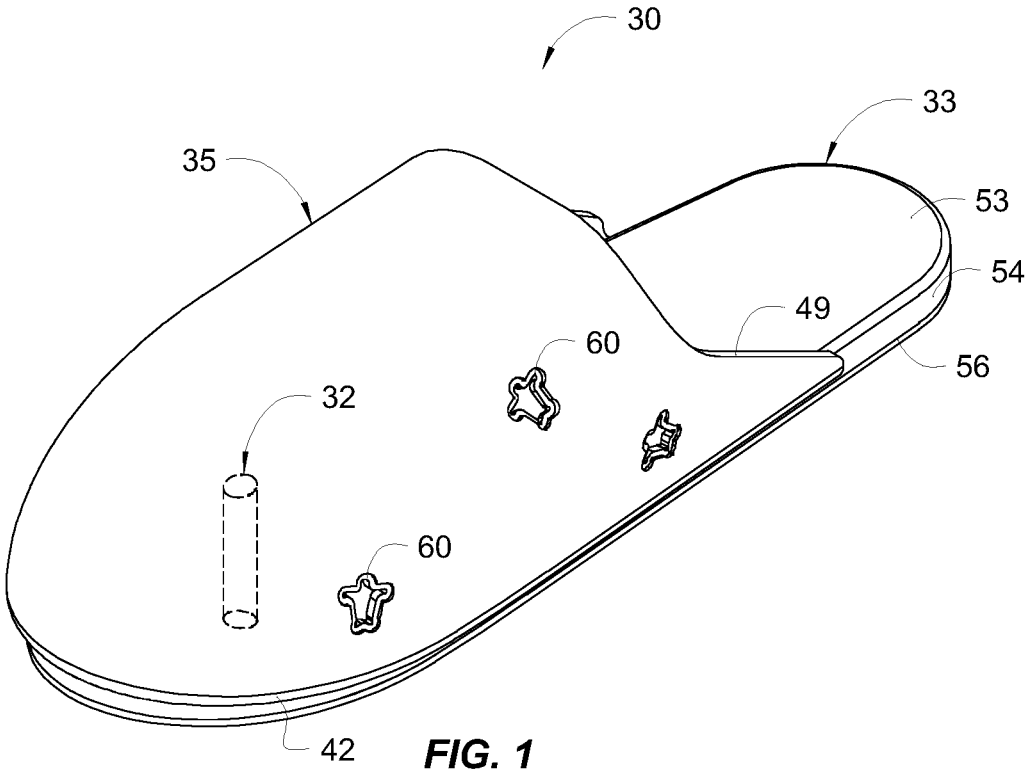
FIG. 1 is a perspective view of exemplary footwear with a toe bar in accordance with various aspects of the present invention.

Turning now to the drawings, wherein like components are designated by like reference numerals throughout the various figures, FIG. 1 shows an article of footwear 30 configured to enclose and comfortably engage a forefoot of a user. The footwear includes an internal upright support 32 that is configured to frictionally engage a user's toes and assist in keeping the footwear on the user's feet. Throughout the present application, the upright support may be interchangeably referred to as a stanchion and/or a toe bar. One will appreciate that the upright support is indeed a stanchion in that it is an upright member that is used to support something (e.g., some other object), as will become evident below.

Figure 5:
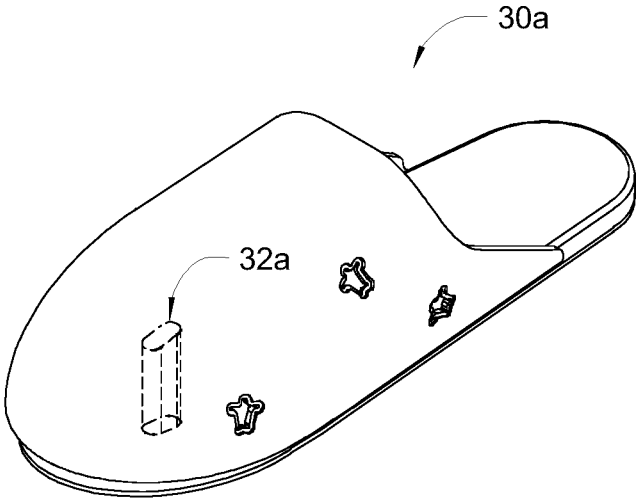
FIG. 5 is a perspective view of other exemplary footwear with another toe bar in accordance with various aspects of the present invention.
Figure 8:
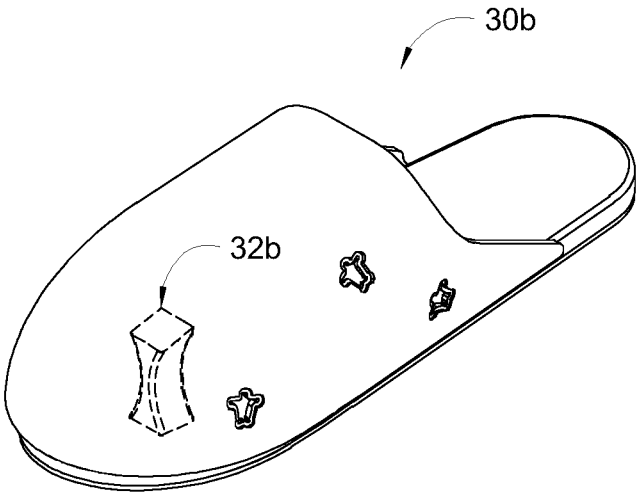
FIG. 8 is a perspective view of other exemplary footwear with another toe bar in accordance with various aspects of the present invention.

Other exemplary embodiments shown in FIG. 5 and FIG. 8 illustrate other configurations of the upright support (e.g., 32*a*, 32*b*) in, accordance with various aspects of the present invention. One will appreciate that the shape, form and construction of the upright support may vary considerably in various embodiments in accordance with various aspects of the present invention.

Referring again to FIG. 1, footwear 30 generally includes a sole 33 and an upper 35 that are interconnected by toe bar 32 (shown in hidden lines). The sole generally includes a forefoot portion 37, a midfoot portion 39, and a hindfoot or rearfoot portion 40. The upper is generally solid and includes a lower perimeter 42 that is attached to a forefoot perimeter 44 of the forefoot portion to form a toe box in an otherwise conventional manner. In particular, the upper defines an interior 46 an interior configured dimensioned to closely receive the forefoot of a user in such a manner that the upper substantially prevents lateral and forward movement of the forefoot with respect to the forefoot portion the sole. The lower perimeter of the upper may also be attached to a midfoot perimeter 47 such that the upper includes a topline 49 that partially defines an opening 51 to the interior that is located above the midfoot portion.

Sole 33 may include an insole 53, a midsole 54, and an outsole 56. The insole or foot bed may be cushiony such that it also promotes frictional and/or mechanical engagement between the sole and a user's foot. For example, insole 53 may be formed of a foam material such as ethyl vinyl acetate (EVA) that is lined or wrapped by a suitable material, including but not limited to cowhide and other natural or synthetic leathers. The cowhide may provide frictional adherence between the sole and the user's feet, while the EVA may compress to form a depression shaped like and receiving a user's forefoot thus mechanically engaging the user's forefoot. Midsole 54 may be formed of a shock-absorbing material in an otherwise conventional manner. For example, the midsole may be formed of a firmer EVA or other suitable material. Outsole 56 maybe formed of a durable material that promotes gripping and traction. For example, the outsole may be rubber outsole such as a zigzag VIBRAM Newflex outsole, or it may be formed of other suitable materials.

Upper 35 may be formed of natural or synthetic leathers and suedes, microsuedes, microfibers, canvas, and/or other natural or synthetic materials and combinations thereof that provide a sufficiently secure and conforming toe box while promoting overall comfort. The inner surface of the upper may include an upper lining 58 formed of a comfortable flexible material having good abrasion resistance, including but not limited to natural or synthetic leathers and suedes, microsuedes, microfibers, viscose, cotton, polyester, elastane, and/or other natural or synthetic materials and combinations thereof. The upper lining may be adhered to the upper in an otherwise conventional manner. The upper may include a plurality of vents 60 to provide cooling. In various embodiments, the vents may be animal shaped, and may be formed by laser cutting, stamping, embossing and/or other suitable means.

In contrast to conventional open-heel footwear where nothing prevents rearward movement of the forefoot, footwear 30 is provide with an inter-toe stanchion extending upwardly through interior 46. The stanchion has a bottom 61 that is attached to forefoot portion 37 of the sole and a top 63 attached to upper 35. The stanchion is positioned medially of a longitudinal centerline CL of the sole (see FIG. 3) and configured to extend between adjacent toes of the user. In the illustrated embodiments, the stanchion is configured to extend between big and second toes of a user, however, one will appreciate that the stanchion may be configured to extend between other adjacent toes. One will further appreciate that two or more stanchions may be provided to further promote engagement with a user's toes.

Stanchion 32 is configured to engage the user's adjacent toes in such a manner to substantially prevent rearward movement of the user's forefoot with respect to the forefoot portion 37 of sole 33. One will appreciate that the stanchion may frictionally and/or mechanically engage the user's toes. For example, the stanchion may have a sufficiently high coefficient of friction such that it discourages a user's toes from slipping rearward along the stanchion. Similarly, the stanchion may have sufficient firmness to cause slight dimpling of a user's toes such that it again discourages as user's toes from slipping rearward along the stanchion. In either case, such engagement between the stanchion and the user's toes helps prevent rearward movement of the user's forefoot with respect to the forefoot portion of the sole, which in turn helps prevent the footwear from falling off a user's foot. One will appreciate that the stanchion may also prevent forward movement of the user's forefoot as well, particularly if the toe box is large or loose fitting to a user.

Stanchion 32 may include a core 65 that is encased by a stanchion/toe-bar lining 67. The core preferably has a relatively firm construction in order to provide secure contact between adjacent toes while providing comfort to the user. Preferably the core is formed of a material that has dimensional consistency and stability in order to provide the footwear with a long-wearing and comfortable toe bar. And the toe-bar lining preferably is a fabric exterior that is both long-wearing and comfortable between a user's toes.

For example, the core may be formed of T-30 polyethylene (PE) foam, which material provides a relatively firm shape while having sufficient give or elasticity to remain comfortable while positioned between a user's toes. One will appreciate that other suitable materials having sufficient firmness and elasticity may be used, such as other PE foams, memory foams and other viscoelastic PE foams, thermoplastic elastomers, rubbers, gels, and combinations thereof. One will also appreciate that additional layers of padding and/or material may be used to enhance comfort.

And the toe-bar lining may be formed of a comfortable flexible material having good abrasion resistance, including but not limited to natural or synthetic leathers and suedes, microsuedes, microfibers, viscose, cotton, polyester, elastane and/or other natural or synthetic materials and combinations thereof.

Figure 2:
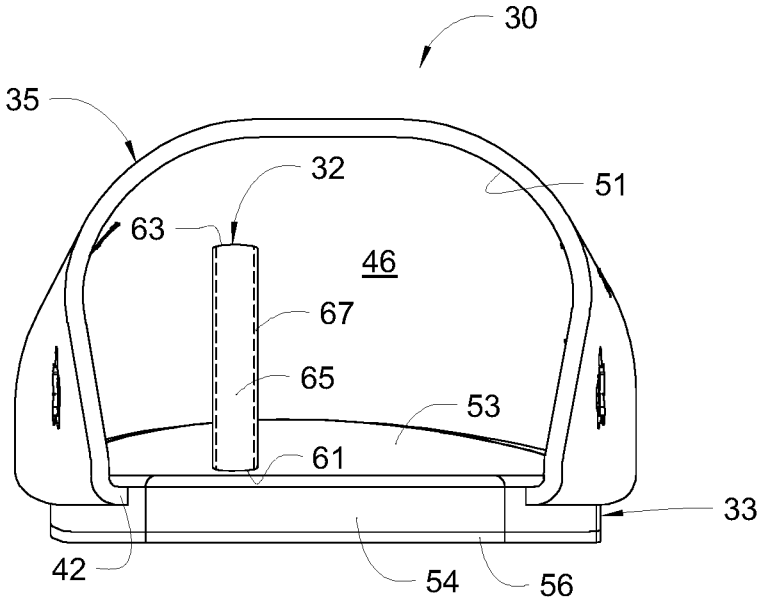
FIG. 2 is a rear view of the footwear of FIG. 1 showing the toe bar extending through the interior of the footwear in accordance with various aspects of the present invention.
Figure 3:
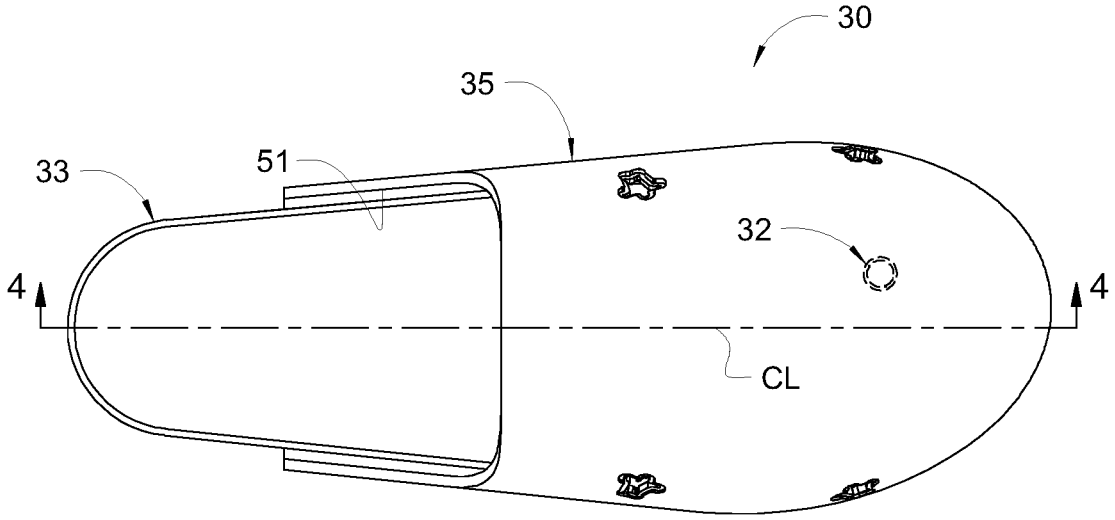
FIG. 3 is a plan view of the footwear of FIG. 1 showing an exemplary location of the toe bar in accordance with various aspects of the present invention.
Figure 4:
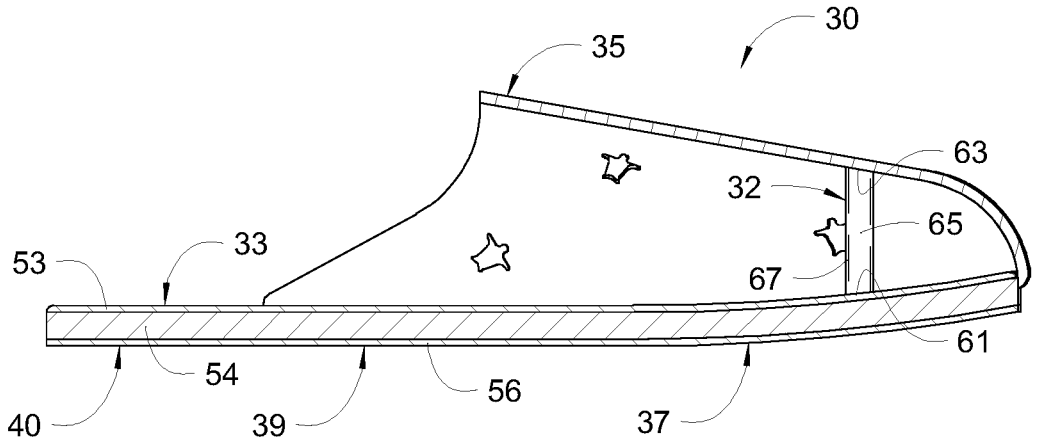
FIG. 4 is a cross sectional view of the footwear of FIG. 1 taken along line 4-4 of FIG. 3 showing the toe bar in accordance with various aspects of the present invention.

With reference to FIG. 2 and FIG. 3, stanchion 32 extends upwardly from sole 33 to upper 35 with its bottom 61 and top 63 affixed to the sole and upper respectively. The bottom of the stanchion may be affixed, directly or indirectly, to the insole and/or the midsole, and the top of the stanchion may be affixed, directly or indirectly, to the upper lining and/or the upper itself. One will appreciate that the stanchion may be affixed by stitching, hot melt glue and/or other suitable means.

As shown in FIG. 1 through FIG. 4, stanchion 32 has a cylindrical shape that is dimensioned to comfortably be received in the gap a user's big and second toes. For example, the stanchion may have a diameter of approximately 0.25 inches (approximately 6 millimeters), however, the actual dimension will vary depending upon the target user of the footwear. For example, children's footwear may require a smaller diameter, women's footwear may require a larger diameter, and men's footwear may require an even larger diameter.

Figure 6:
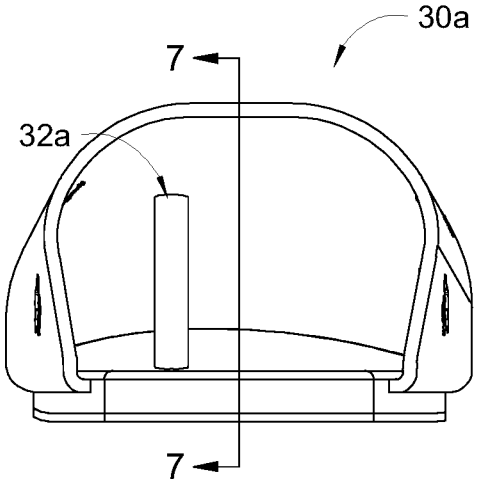
FIG. 6 is a rear view of the footwear of FIG. 5 showing the toe bar extending through the interior of the footwear in accordance with various aspects of the present invention.
Figure 7:
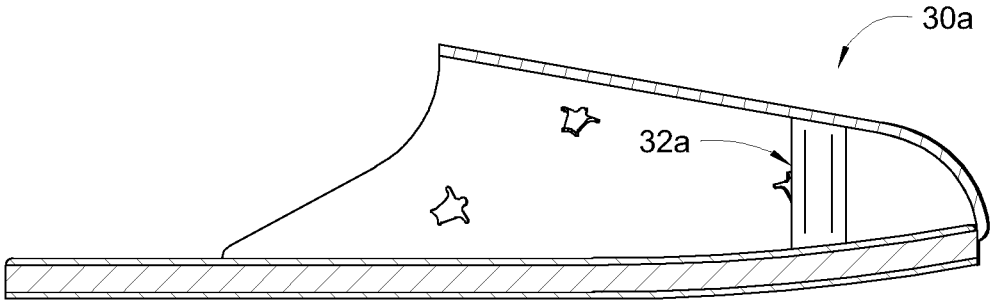
FIG. 7 is a cross sectional view of the footwear of FIG. 5 taken along line 7-7 of FIG. 6 showing the toe bar in accordance with various aspects of the present invention.
Figure 9:
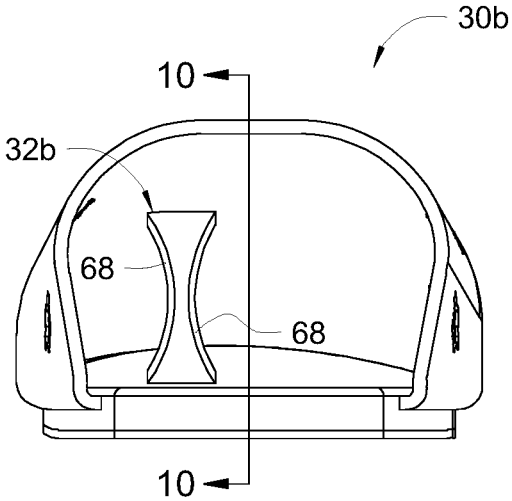
FIG. 9 is a rear view of the footwear of FIG. 8 showing the toe bar extending through the interior of the footwear in accordance with various aspects of the present invention.
Figure 10:
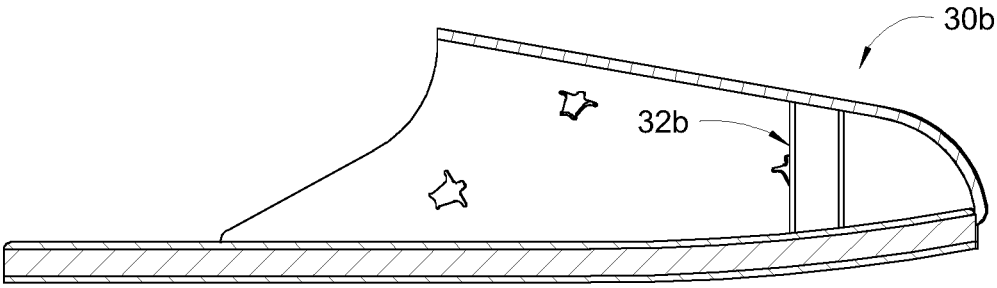
FIG. 10 is a cross sectional view of the footwear of FIG. 8 taken along line 10-10 of FIG. 9 showing the toe bar in accordance with various aspects of the present invention.

One will appreciate that the shape of the stanchion may vary in accordance with various aspects of the present invention. For example, stanchion 32*a* has an elongated oblong or obround shape as shown in FIG. 5 to FIG. 7, which configuration may provide further frictional engagement of the stanchion with a user's toes. And stanchion 32*b* has a form-fitting shape as shown in FIG. 8 to FIG. 10, which configuration may provide further frictional and/or mechanical engagement of the stanchion with user's toes. For example stanchion 32*b* may have recesses 68 on both its medial and lateral sides which are configured to conform with the shape of a user's toes. One will appreciate that the stanchion may be provided with other suitable shapes (e.g., hourglass, wedge, teardrop, etc.) that would comfortably extend upwardly between a user's toes while providing a suitable engaging surface.

In accordance with various aspects of the present invention, the above-described footwear provides security and flexibility in a shoe that is easy to slip on and off. In particular the closed-toe upper protects the user's toes and feet, the open-back upper allows one to easily slip into and out of a shoe, and the other above-described configurations promote physical activities (e.g., running, jumping, climbing, etc.) because the configurations of the toe bar and/or cushiony insole lessen the chance of the shoe from falling off while engaged in such activities.

For convenience in explanation and accurate definition in the appended claims, the terms "upwardly", "lower", etc. are used to describe features of the exemplary embodiments with reference to the positions of such features as displayed in the figures.

In many respects, various modified features of the various figures resemble those of preceding features and the same reference numerals followed by subscripts "a" and "b" designate corresponding parts.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An article of footwear configured to enclose and comfortably engage a forefoot of a user, the article comprising:

a sole including a forefoot portion and a rearfoot portion;

a closed-toe, open-heel upper having an interior configured to closely receive the forefoot and substantially prevent lateral and forward movement of the forefoot without preventing rearward movement of the forefoot with respect to the forefoot portion, the upper including a lower perimeter attached to a forefoot perimeter of the forefoot portion and defining an interior configured to receive the forefoot of the user; and an inter-toe stanchion extending upwardly through the interior, the stanchion having a bottom attached to the forefoot portion of the sole and a top attached to the upper, wherein the stanchion is configured to extend between and engage adjacent toes of the user to substantially prevent movement of the forefoot with respect to the forefoot portion of the sole.

2. An article of footwear according to claim 1, wherein the sole includes an insole, a midsole, and an outsole.

3. An article of footwear according to claim 2, wherein the insole is cushioned.

4. An article of footwear according to claim 1, wherein the sole includes a midfoot portion and the upper includes a topline partially defining an opening to the interior, wherein the lower perimeter of the upper is also attached to a midfoot perimeter of the sole, and wherein the opening is located above the midfoot portion.

5. An article of footwear according to claim 1, wherein the upper is leather.

6. An article of footwear according to claim 5, wherein the upper includes a plurality of animal-shaped openings.

7. An article of footwear according to claim 1, wherein the stanchion is positioned medially of a longitudinal centerline of the sole.

8. An article of footwear according to claim 7, wherein the stanchion is configured to extend between big and second toes of the user.

9. An article of footwear according to claim 1, wherein the stanchion includes a foam core.

10. An article of footwear according to claim 9, wherein the stanchion includes a stanchion lining encasing the foam core.

11. An article of footwear according to claim 9, wherein the stanchion has a cylindrical shape.

12. An article of footwear according to claim 9, wherein the stanchion has an elongated shape extending longitudinally along the sole.

13. An article of footwear according to claim 1, wherein the stanchion has a form-fitting shape with concave recesses on medial and lateral sides of the stanchion.

14. An article of footwear according to claim 13, wherein the stanchion is configured to extend between big and second toes of the user, and wherein the medial-side and lateral-side recesses are configured to abut against the big toe and the second toe, respectively.

15. An article of footwear according to claim 1, wherein the footwear further includes an upper lining along an interior surface of the upper, wherein the top of the stanchion is attached to the upper lining and the upper.

16. An article of footwear comprising:

a sole including a forefoot portion and a rearfoot portion;

a closed-toe, open-heel upper having an interior configured to closely receive the forefoot and substantially prevent lateral and forward movement of the forefoot without preventing rearward movement of the forefoot with respect to the forefoot portion, the upper attached to the forefoot portion and defining an interior configured to receive the forefoot of the user;

an upper lining extending along an interior surface of the upper; and an oblong toe bar extending upwardly through the interior, the toe bar including a foam core and a toe-bar lining encasing the foam core, wherein a bottom of the lining is affixed to the forefoot portion of the sole and a top of the toe-bar lining is affixed to the upper lining, wherein the toe bar is configured to extend between and engage big and second toes of the user to substantially prevent movement of the forefoot with respect to the forefoot portion of the sole.

17. An article of footwear according to claim 16, wherein the upper includes a plurality of animal-shaped openings.

18. An article of footwear according to claim 16, wherein the upper is leather.

19. An article of footwear according to claim 16, wherein the oblong toe bar is configured to extend between big and second toes of the user.

20. An article of footwear according to claim 16, wherein the oblong toe bar extends longitudinally along the sole.

* * * * *